US009109324B2

(12) United States Patent
Chatot et al.

(10) Patent No.: US 9,109,324 B2
(45) Date of Patent: Aug. 18, 2015

(54) TUMBLE DRYING DEVICE AND METHOD FOR OPERATING A TUMBLE DRYING DEVICE

(75) Inventors: Brian Chatot, Berlin (DE); Mike Peebles, Berlin (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 900 days.

(21) Appl. No.: 12/316,458

(22) Filed: Dec. 12, 2008

(65) Prior Publication Data

US 2009/0159301 A1 Jun. 25, 2009

(30) Foreign Application Priority Data

Dec. 20, 2007 (DE) ..... 10 2007 061 521

(51) Int. Cl.

| | |
|---|---|
| ***A62C 37/00*** | (2006.01) |
| ***D06F 58/28*** | (2006.01) |
| ***D06F 58/20*** | (2006.01) |
| *A62C 3/16* | (2006.01) |
| *A62C 35/68* | (2006.01) |

(52) U.S. Cl.

CPC ..... *D06F 58/28* (2013.01); *D06F 58/20* (2013.01); *A62C 3/16* (2013.01); *A62C 35/68* (2013.01); *D06F 2058/2858* (2013.01)

(58) Field of Classification Search

CPC ..... A62C 35/16; A62C 35/68; D06F 58/20; D06F 58/28; D06F 2058/2858

USPC ..... 34/87, 88, 89, 524, 544; 68/12.06

See application file for complete search history.

(56) References Cited

U.S. PATENT DOCUMENTS

| | | | | |
|---|---|---|---|---|
| 2,980,543 | A * | 4/1961 | Hale et al. | 426/307 |
| 4,067,703 | A * | 1/1978 | Dullien et al. | 95/218 |
| 5,396,715 | A | 3/1995 | Smith | |
| 5,768,730 | A * | 6/1998 | Matsumoto et al. | 8/159 |
| 6,505,418 | B1 | 1/2003 | Confoey et al. | |
| 6,648,077 | B2 | 11/2003 | Hoffman | |
| 6,715,216 | B1 | 4/2004 | Salameh et al. | |
| 2002/0032931 | A1 * | 3/2002 | Teran et al. | 8/158 |
| 2002/0184786 | A1 | 12/2002 | Miller, II | |
| 2003/0189132 | A1 * | 10/2003 | Brady et al. | 244/118.5 |
| 2004/0256119 | A1 | 12/2004 | Jerg | |
| 2005/0023008 | A1 | 2/2005 | Kegler | |

FOREIGN PATENT DOCUMENTS

| | | |
|---|---|---|
| DE | 33 40 652 | 5/1985 |
| DE | 39 18 239 | 12/1990 |
| DE | 100 25 204 | 9/2001 |
| GB | 2 079 911 | 1/1982 |
| GB | 2 205 037 | 11/1988 |
| JP | 11-216294 | 8/1999 |
| JP | 2002233588 A * | 8/2002 |
| WO | WO 2007/119970 | 10/2007 |

OTHER PUBLICATIONS

National Search Report DE 10 2007 061 521.5.

* cited by examiner

*Primary Examiner* — Jiping Lu

(74) *Attorney, Agent, or Firm* — James E. Howard; Andre Pallapies

(57) ABSTRACT

A tumble dryer with a fire-extinguishing facility includes a fire sensor for detecting a fire in a laundry drum of the tumble dryer, and an extinguishing medium supply device for introduction of an extinguishing medium into the laundry drum of the tumble dryer on actuation of a fire-extinguishing device. The extinguishing medium supply device includes a laundry freshening device.

23 Claims, 2 Drawing Sheets

TUMBLE DRYING DEVICE AND METHOD FOR OPERATING A TUMBLE DRYING DEVICE

BACKGROUND OF THE INVENTION

The invention relates to a tumble drying device and a method for operating a tumble drying device.

Tumble drying devices for drying laundry are generally known. A further area of application of some of said tumble drying devices consists of freshening up laundry. To freshen up laundry either at the end of a drying process or also to freshen up laundry already dried, a liquid (mostly water), which if necessary can also contain additives such as perfume, is sprayed onto the laundry. To provide the liquid such tumble drying devices accordingly feature a liquid container. The liquid container can be provided as a self-contained unit, but can also be used as a condensation water container. With tumble dryers having a fixed water connection the liquid can also be supplied from such a connection.

Also generally known is the problem of overheating enabling a fire to break out in rare exceptional cases. A fire cannot be entirely excluded, especially when drying textiles with a very high and fine proportion of lint. Accordingly high demands are imposed on tumble dryers to enable these to be designed so safely as not to allow any possible fire to spread from the laundry drum to other components of the tumble dryer or even into the surroundings of the tumble dryer. Accordingly such a tumble dryer is to be manufactured from materials which are fire-resistant and consequently represent a significant cost item in the production of said tumble dryer.

SUMMARY OF THE INVENTION

An object of the invention is to propose an alternate fabrication method or construction for a tumble drying device which makes possible a simple yet still safe construction for avoiding a fire or even a spread of the fire.

The tumble drying device (separate tumble dryer or washer-dryer) is equipped with a fire-extinguishing device, with the following features: At least one fire sensor to detect a fire in progress or breaking out in the tumble drying device, especially in the laundry drum, and at least one extinguishing medium supply facility for bringing the extinguishing medium into the tumble drying device, especially into the laundry drum on actuation of the fire-extinguishing device, with the extinguishing medium supply facility including a laundry freshening device.

Basically a wide variety of fire sensors for direct or indirect fire detection can be used. Thus for example gases in the outlet air can be detected on the basis of carbon dioxide content or of particles. At a temperature which indicates that a fire has broken out or that there is a threat of a fire breaking out, the extinguishing medium, especially a liquid, is introduced into the laundry drum, especially sprayed in, so that a fire in progress or breaking out is extinguished.

A tumble drying device in such cases is taken to be both a combined washer-dryer for washing and drying and also a tumble dryer as a standalone unit.

The extinguishing medium supply device includes a laundry freshening device. Advantageously this enables a laundry freshening device known per se which, to remove odors from textiles, creates mist, droplets or steam from liquid and introduces it into the laundry drum, to be used as a component of the fire-extinguishing device. This means that tumble drying devices with a functionality for freshening up or ventilating items of clothing can also be used.

The fire-extinguishing device preferably features a control device which is designed and/or programmed to trigger the fire-extinguishing device or a corresponding fire extinguishing function when such a situation is detected.

The fire sensor is especially advantageously a temperature sensor for detecting a temperature obtaining in the tumble drying device, especially in a laundry drum, and for outputting a corresponding temperature signal and the control device is preferably embodied and/or programmed to trigger a corresponding fire extinguishing function if the temperature signal exceeds a predetermined fire threshold value.

The temperature sensor can be an infrared sensor or an NTC thermistor. The fire or especially temperature sensor can preferably be arranged on a sleeve. In addition to gases arising, increasing temperature values can also be detected by means of a direct measurement infrared sensor or an indirect measurement NTC resistor (NTC: Negative Temperature Coefficient; thermistor) for example. Advantageously this means that a temperature sensor and a control device as components of a tumble drying device that are usually already present and are known per se can be used to embody a fire-extinguishing device. These only have to be arranged so that, if a fire breaks out in the tumble drying device, especially in its laundry drum, or at a temperature which constitutes the threat of an outbreak of fire, the fire-extinguishing device is triggered. The temperature can for example be detected directly via a fire or temperature sensor directed into the laundry drum. The temperature can for example be recorded indirectly using a fire or temperature sensor, which measures outgoing or incoming air in the process duct.

In particular a gas or a powder can also be used as the extinguishing medium as well as a liquid to extinguish a fire. As well as extinguishing media which completely extinguish a fire, such media also include media which cool down an overheated temperature.

In particular the extinguishing medium can be introduced directly into the laundry drum and/or into a process air duct leading into the laundry drum. The medium can be introduced directly for example via an opening in a sleeve separating laundry drum and door from one another.

The extinguishing medium supply device can feature a liquid container and a fill level sensor for detecting the fill level of the liquid in the liquid container, with preferably the or a further control device then being embodied and/or programmed, should a fill level drop below a threshold value, only to allow further liquid to be withdrawn for operation of the fire-extinguishing device. This guarantees that a minimum volume of liquid always remains in the liquid container to extinguish any fire occurring. This is especially of significance if the liquid is also used for other purposes, e.g. freshening-up laundry.

The extinguishing medium supply device can be an extinguishing medium container for provision especially of a gaseous or powdered extinguishing medium and a transport device, especially a fan, for transporting the extinguishing medium into the laundry drum on actuation of the fire-extinguishing device. This also enables extinguishing media to be used which enable a more effective extinguishing effect than water to be achieved.

The extinguishing medium supply device can especially be a chemical propulsion unit for transporting the extinguishing medium into the laundry drum. This makes rapid extinction possible, especially if a fan is used, with it having to be borne in mind that such an extinguishing medium may possibly attack textiles in the laundry drum, to make possible safe extinction of a fire which will not usually occur and thus prevent serious consequences arising from the fire spreading.

The control device can be embodied and/or programmed, on actuation of the fire-extinguishing device, to suppress an air stream flowing into or out of the laundry drum. In particular if an air duct with at least one valve able to be controlled by means of the control device is connected to the laundry drum, such a valve can be controllable for closing off the air duct when the fire-extinguishing device is triggered. This allows a feeding-in of process air to the laundry drum or preferably, on locking of an outlet air duct as the air duct, an extraction of exhaust air to be suppressed, so that no smoke escapes from the laundry drum into the surroundings. In addition any fire which has occurred or is occurring is smothered in its own smoke.

A tumble drying device with at least one process air fan able to be deactivated on actuation of the fire-extinguishing device is preferred. The control device can deactivate all such process air fans so that any circulation of process air in the laundry drum is suppressed. This especially prevents a process air fan running hot and thereby creation of a further fire risk when the closure devices are closed off.

The control device is preferably embodied and/or programmed to output a warning signal when the fire-extinguishing device is triggered and/or to interrupt a drying or freshening mode. If a visual or an audible signal is used, a warning signal enables people in the environment to be alerted to the danger of a fire. If communication signals are used, persons or facilities at remote locations can also be warned. The interruption of the drying or freshening mode prevents further damage through jamming of drive units or failure of seals.

In particular the control device is embodied and/or programmed, on actuation of the fire-extinguishing device, to activate an operating mode in which in multiple oscillations in a first step when the laundry drum has stopped the extinguishing medium is introduced into the laundry drum and in a second step the laundry drum is rotated. The control device can then preferably be embodied and/or programmed, during the second step, to activate a half or a complete revolution of the laundry drum. This then rotates the laundry which was previously at the top of the drum a maximum of one time, distributes the extinguishing medium and directly applies new extinguishing medium again.

To this end the control device can be embodied and/or programmed, on actuation of the fire-extinguishing device, to activate an operating mode in which, by comparison with a freshening operating mode, an increased volume of liquid is introduced into the laundry drum.

In a corresponding method for operating a tumble drying device, on detection of a fire having occurred or occurring in the laundry drum, a fire-extinguishing device is triggered. Preferably a temperature obtaining in the laundry drum is detected and a fire-extinguishing device is triggered if the detected temperature exceeds a fire threshold value.

An especially advantage in the provision of such a fire-extinguishing function lies in the fact that the tumble drying device can be constructed with a design which favors less cost-intensive materials. Instead of the use of expensive, especially metallic materials, a corresponding fire extinguishing construction is provided, so that a fire is not prevented from spreading and emitting thick smoke, but instead of this a fire is preferably already actively extinguished at its seat. Ideally components of a freshening function already present can be used in such cases, so that no additional outlay is required. Even If a corresponding pump or a container for provision of an extinguishing medium has to be installed as an extra unit, this is still better than using expensive materials to avoid the spread of a fire. The effect of extinguishing a fire instead of containing it is additionally that gases and vapors that are unpleasant and possibly even damaging to health are prevented from escaping into the environment. Provided only lint at the edge of the laundry drum within the drum housing catches fire, the fire jumping across to the laundry in the laundry drum is also avoided, so that under favorable circumstances the laundry does not have to be removed completely.

BRIEF DESCRIPTION OF THE DRAWINGS

An exemplary embodiment is explained in more detail below with reference to the schematic diagram. The figures are as follows:

FIG. 1 shows a tumble dryer 1 with a laundry drum 2, in which laundry 3 is located. The transition between the rotatably supported laundry drum 2 in the tumble dryer 1 and a front-side door of the tumble dryer 1 not shown is formed by a flange or a sleeve 4, which is attached on the housing of the tumble dryer 1 between the door and the laundry drum 2. To control various functionalities known per se the tumble dryer 1 has a control device 5. In a manner known per se the laundry drum 2 is supported in a drum housing 6, which in relation to the other components of the tumble dryer 1 forms a seal both in respect of an air process flow and also liquid. In order to let process air into the drum housing 6 and to let it out of the housing again, at least one air duct 7 is embodied in the tumble dryer 1, with the air duct 7 shown as a typical example in the drawing leading as an outlet for warm and moist process air out of the drum housing 6 into the surroundings of the tumble dryer 1 or to a condenser.

DETAILED DESCRIPTION OF EXEMPLARY EMBODIMENTS OF THE PRESENT INVENTION

Figure 1:
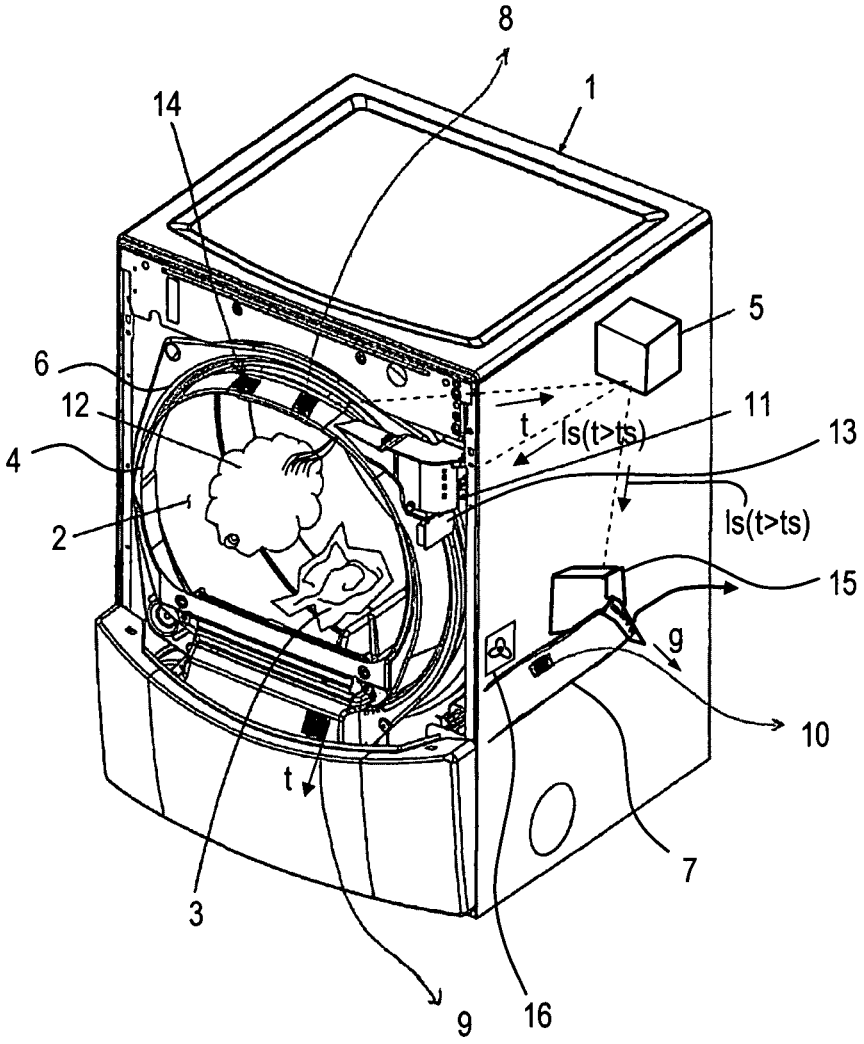
FIG. 1 is a front view of a tumble dryer with the front removed as well as a schematic of components installed in such a tumble dryer.

Usually this type of tumble dryer 1 is designed with a heating device not shown in the drawing for heating up the process air before its introduction into the laundry drum 2. To control the heating process in the heating device, such a tumble dryer 1 features at least one temperature sensor. The temperature sensor in this case can be arranged at a corresponding suitable position within the process air area in order to detect the temperature obtaining in this area. A temperature signal provided in accordance with the temperature detected is supplied by the temperature sensor to the control device 5. This causes a corresponding activation of the heating device, so that the process air at the location of the heating device is correspondingly heated up more or less strongly.

A basic idea of the tumble dryer 1 is to employ the temperature detection to provide a fire-extinguishing function. A fire-extinguishing device embodied accordingly in the tumble dryer 1 accordingly consists of a plurality of individual components, especially the control device 5, a fire sensor, for which purpose preferably at least one temperature sensor can be used, as well as an arrangement for provision of an extinguishing medium, which in the event of a fire is let into the laundry drum or possibly even into other sections of the tumble dryer in which an extinguishing function is needed. Described below are accordingly the different possible components which are suitable for providing a fire sensor function and/or an extinguishing function. In this case the individual components can if necessary also be used in combination with each other, in order to provide redundant systems or make possible a more effective extinguishing function.

FIG. 1 shows examples of three different fire sensors. A temperature sensor 8 is depicted as an example of a first fire sensor which is arranged on the drum sleeve 4. This directly detects a temperature in the area of the laundry drum 2 in order to be able to output a corresponding temperature signal t to the control device 5 via a line which is only sketched in. A further typical temperature sensor 9 is shown outside the laundry drum 2 but within the drum housing 6 and is typically arranged on the floor of the drum housing 6. Such a temperature sensor 9 can for example be an NTC thermistor, which detects a negative temperature coefficient and outputs a corresponding temperature signal t to the control device 5.

A further typical fire sensor is typically arranged as a smoke sensor 10 in the air duct 7. With such a smoke sensor 10 the process air can be analyzed for smoke or other gases which signal a fire or smoldering fire, so that a corresponding smoke signal g can be output to the control device 5.

The control device 5 receives corresponding temperature signals t or a smoke signal g and with the aid of these signals can perform a fire monitoring function. As soon as the temperature signals t or a corresponding smoke signal g deviates from a usual level, especially entering areas in which a fire arises within the laundry drum or in the other area of the process air exchange, the control device 5 can accordingly actuate an extinction function. Accordingly the control device 5 or a control device provided separately for the extinction function is embodied and/or programmed, on such detection of a fire especially arising or in progress in the laundry drum, to trigger the fire-extinguishing function or fire-extinguishing device.

Temperature and/or fire threshold values are preferably stored in a memory which is assigned to the control device 5 and not shown in the drawing, which can optionally be adapted to different functions or operating states. Especially if the corresponding fire threshold value ts is exceeded by the temperature signal t, at least one extinguishing signal 1*s* is output to corresponding further components of the fire-extinguishing device by the control device.

An example of a first extinguishing medium supply device 11 is depicted with reference to FIG. 1. This extinguishing medium supply unit 11 consists of a container for holding an extinguishing medium 12 and a chemical propulsion unit 13 for transporting the extinguishing medium 12 into the laundry drum 2 in the event of the fire-extinguishing device being triggered. The extinguishing medium 12 can typically be a gaseous or powdered extinguishing medium. A liquid or fluid extinguishing medium can also be provided by such an extinguishing medium supply device 11.

In accordance with an extinguishing device function able to be employed as an alternative or in addition, a laundry freshening device already known per se and present can be employed for extinguishing a fire which is in progress or breaking out. In this case liquid is sprayed into the laundry drum 2 from especially a liquid container of such a laundry freshening device via a corresponding spray nozzle 14. Such spray nozzles 14 for spraying in liquid or other extinguishing media are preferably arranged so that the extinguishing medium also reaches the laundry 3 directly. A preferred arrangement of the spray nozzle 14 is thus located in the sleeve 4, so that the extinguishing medium does not have to enter like process air through openings in the actual walls of the drum into the inner chamber of the laundry drum 2, but gets into the laundry drum 2 directly from the door side.

A valve 15 is depicted in the drawing as a further typical extinguishing device, which is arranged on the air duct 7 such that a triggering of the fire-extinguishing device controls the valve 15 by means of the extinguishing signal 1*s* so that it closes off the air duct 7. The closing-off of the air duct 7 by means of the valve 15 suppresses a further flow air flow in the air duct 7. In the case of an outlet air duct as the air duct 7, this prevents smoke being taken out of the laundry drum 2, which in the case of a outlet duct leading into the outer space of the tumble dryer 1, prevents smoke escaping into the environment. Advantageously smoke remaining in the laundry drum 2 or in the air duct also has the effect of any fire occurring then going out because of lack of oxygen supply. A further extinguishing function thus consists of an air circulation being suppressed in the process air duct and the fire which is breaking out or the smoldering fire being extinguished. Preferably in this connection, on actuation of the fire-extinguishing device the control device 5 also deactivates the process air fans 16.

Figure 2:
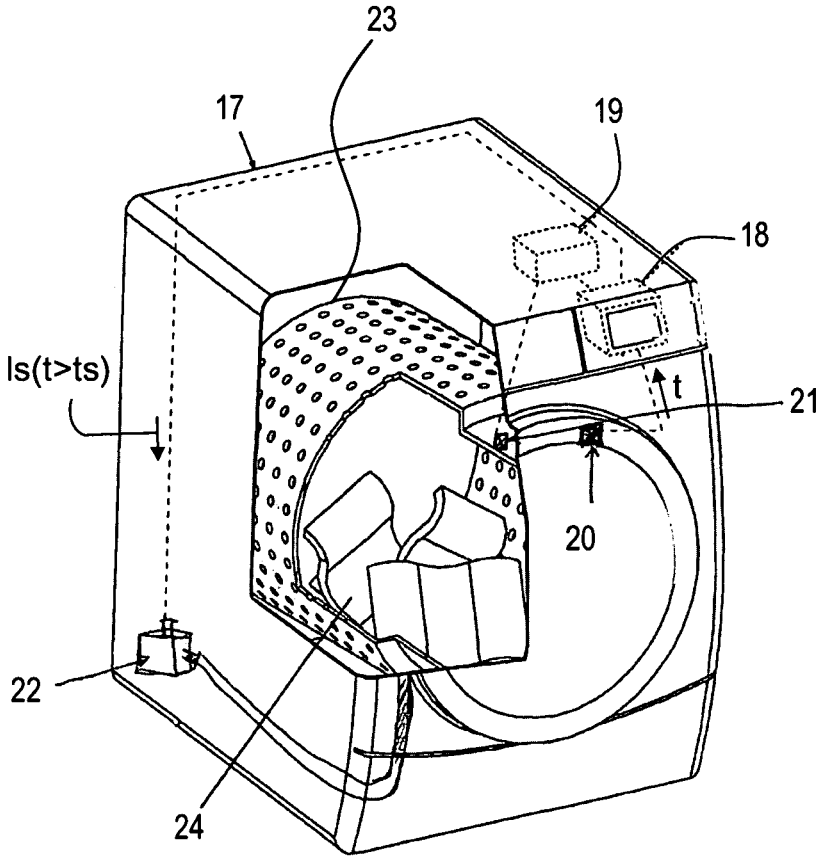
FIG. 2 is a part cross section of an embodiment modified in relation to the previous figure with further typical components to make possible a fire-extinguishing function.

FIG. 2 shows a further typical embodiment of a tumble dryer 17. Different components and functions are each also described with reference to the information given for FIG. 1 provided comparable or equivalent components and functions are described or shown.

The tumble dryer 17 is again equipped with a control device 18 which, as the control device permanently assigned to the tumble dryer is provided and embodied for control of its usual functionalities or as a self-contained control device of a fire-extinguishing device. The figure again shows a typical extinguishing medium supply device 19 for storing, and in the case of triggering of the fire-extinguishing device, for outputting a corresponding extinguishing medium. A temperature signal t is output to the control device 18 via a temperature sensor 20 for example. If the temperature signal t exceeds a temperature threshold value or fire threshold value ts, an extinguishing signal 1*s* is accordingly triggered, so that the extinguishing medium supply device 19 is activated.

As an alternative to the extinguishing medium supply device 19 depicted, the diagram also shows a laundry freshening device 22, which is likewise able to be used as a component of a fire-extinguishing device. When the fire-extinguishing device or a corresponding fire-extinguishing function is triggered, the laundry freshening device 22 sprays a liquid, especially a liquid otherwise provided as a freshening liquid, into the laundry drum 23.

To extinguish a fire which is breaking out or is in progress, a specific rotation of the laundry drum 23 is preferably activated by the control device 18. Instead of a plurality of consecutive continuous rotations, the laundry drum 23 is brought to a stop in a first step, in order in a second step to introduce extinguishing medium, so that the extinguishing medium is introduced onto the laundry 24 located in the laundry drum 23 and lying in said drum. In a subsequent second step a rotation of the laundry drum 23 is then activated in order to turn over the laundry 24 and bring about an even mixing of the laundry 24 with the introduced extinguishing medium. Preferably in such cases the laundry drum 23 is only rotated by between half a revolution and especially a complete revolution. In this case the laundry 24 is turned once in the ideal case, so the laundry which was previously at the bottom is now at the top. Subsequently the sequence of the first and of the second steps is repeated until such time as extinguishing medium is available and/or a fire in progress or breaking out is detected. This brings about a more even mixing of the laundry 24 with the extinguishing medium.

Preferably, when a liquid container of a laundry freshening device 22 is used which does not have a connection to a water line, a fill level sensor can be provided which signals a fill level threshold value to the control device, so that, if the level falls below such a fill level threshold value, a further withdrawal of liquid for the freshening function is suppressed. This ensures that there is always a minimum level of fluid in the fluid container sufficient for any extinguishing function which might be required.

In order to bring the extinguishing medium to the desired point, especially in the laundry drum 2; 23 and onto the laundry 3; 24, if the fire-extinguishing device is triggered, in the case for example of a laundry freshening device, the extinguishing medium or its liquid can be transported via its pump. In any event there should preferably be provision for the extinguishing medium to be transported as quickly as possible to the seat of the fire, so that either an especially powerfully dimensioned pump or a self-contained transport device is provided which is dimensioned and embodied for fast transportation of the extinguishing medium to the seat of the fire.

In accordance with different and also combinable embodiments a tumble drying device is thus equipped with a fire-extinguishing device or fire-extinguishing function. If a fire or a temperature which is unnaturally high for a current operating state is detected especially in the laundry drum of the tumble dryer, a corresponding extinguishing signal is sent to the fire-extinguishing system and/or for a blocking of an air duct to allow an appropriate reaction. In particular this action sprays a fire-extinguishing medium into the laundry drum of the tumble dryer, where the high temperature is reduced and/or the fire is extinguished. A fire or a temperature value higher than a normal temperature can preferably be detected using a direct sensor, for example an infrared sensor or indirect sensors, for example an NTC thermistor or a gas sensor.

In particular a freshening device known per se can be used, which usually has a heater, a pump, a liquid tank, an NTC, pipes, a nozzle and a control device as its components. In accordance with a first function for freshening the tank or liquid container is filled with liquid, preferably distilled water. As an alternative for variants with a direct water connection pump, direct freshening options of the control device can be selected. Subsequently clothing is introduced into the laundry drum and the vapor function or freshening function is then selected. A corresponding program has a duration of for example 20 minutes and adds over a liter of water vapor to the laundry in the laundry drum of the tumble dryer. In the case of the freshening device with a fixed water connection, or in the case of a condensing dryer with a fixed water connection, theoretically an unlimited volume of water can be supplied, which is especially advantageous for an extinguishing function.

To make possible a freshening/extinguishing function, it is sensible for the container for the extinguishing medium always to be connected to a fixed water supply or to have an at least sufficient volume of extinguishing medium, especially water. If necessary a separate liquid container can be provided as an extinguishing liquid container in addition to a container for freshening liquid. In the event of a fire being detected via the fire sensors, especially temperature sensors on the upper side and the lower side of the sleeve, the extinguishing device is activated. By contrast with a freshening program, an extinguishing program is preferably activated which spays a greater volume of extinguishing medium or liquid into the laundry drum by comparison with the freshening function. In the case of a restricted extinguishing medium from a tank the entire amount of the liquid or of the extinguishing medium is preferably introduced into the laundry drum, with the duration of such a process always able to be extended in order to make it possible to mix in the extinguishing medium evenly with the laundry. For example with the drum at a standstill the extinguishing medium can be introduced for two minutes into the laundry drum, after which the drum is made to rotate for e.g. 15 seconds, before extinguishing medium is introduced again. In the case of a freshening tank for a freshening function the process can preferably last between 10 and 15 minutes.

The invention claimed is:

1. A tumble dryer, with a fire-extinguishing facility, the device comprising:

a fire sensor for detecting a fire in a laundry drum of the tumble dryer; and an extinguishing medium supply device for introduction of an extinguishing medium into the laundry drum of the tumble dryer on actuation of a fire-extinguishing device, wherein the extinguishing medium supply device is a laundry freshening device, and wherein the laundry freshening device includes a nozzle and a control unit, the control unit controlling a supply of a volume of liquid to the nozzle to create a mist, droplets, or steam from the volume of liquid, and to introduce the mist, droplets, or steam into the laundry in the laundry drum for removing odors and freshening the laundry in the laundry drum and controlling a supply of the extinguishing medium to the nozzle to introduce the extinguishing medium into the laundry drum of the tumble dryer for extinguishing the fire.

2. The tumble dryer of claim 1, wherein the fire-extinguishing device comprises a controller that triggers the fire-extinguishing device on detection of a fire.

3. The tumble dryer of claim 2, wherein the fire sensor comprises a temperature sensor for detecting a temperature in the laundry drum and for outputting a corresponding temperature signal, and wherein the controller triggers the fire-extinguishing device if the temperature signal exceeds a fire threshold value.

4. The tumble dryer of claim 3, wherein the temperature sensor comprises an infrared sensor or an NTC thermistor.

5. The tumble dryer of claim 2, wherein the controller suppresses an air stream into or out of the laundry drum on actuation of the fire-extinguishing device.

6. The tumble dryer of claim 5, further comprising an air duct with a valve able to be controlled by means of the controller is connected to the laundry drum and the valve is able to be activated on actuation of the fire-extinguishing device for closing-off the air duct.

7. The tumble dryer of claim 2, wherein the controller outputs a warning signal and/or interrupts a drying mode or freshening mode on actuation of the fire-extinguishing device.

8. The tumble dryer of claim 2, wherein the controller activates an operating mode in which extinguishing medium is introduced into the laundry drum in multiple oscillations in a first step when the laundry drum is at a standstill and in a second step when the laundry drum is being turned.

9. The tumble dryer of claim 2, wherein the controller activates an operating mode in which the extinguishing medium is introduced into the laundry drum by the extinguishing medium supply device, wherein, in the operating mode, a greater volume of liquid is introduced into the laundry drum than a volume of liquid that is introduced into the laundry drum in a freshening operating mode in which the laundry in the laundry drum is freshened by the laundry freshening device introducing the mist, droplets, or steam into the laundry in the laundry drum.

10. The tumble dryer of claim 1, wherein the fire sensor is on a sleeve.

11. The tumble dryer of claim 1, wherein the extinguishing medium supply device comprises a liquid container and a fill level sensor for detecting a fill level of a liquid in the liquid container, and further comprising a controller that only allows a further withdrawal of fluid for operation of the fire-extinguishing device when the level falls below a fill value threshold.

12. The tumble dryer of claim 1, wherein the extinguishing medium supply device comprises an extinguishing medium container for provision of an especially gaseous or powdered extinguishing medium and a fan for transporting the extinguishing medium into the laundry drum on actuation of the fire-extinguishing device.

13. The tumble dryer of claim 1, wherein the extinguishing medium supply device comprises a chemical propulsion unit for propelling the extinguishing medium into the laundry drum.

14. The tumble dryer of claim 1, further comprising a process air fan able to be deactivated on actuation of the fire-extinguishing device.

15. The tumble dryer of claim 1, wherein the laundry freshening device introduces a volume of liquid into the laundry in the laundry drum of the tumble dryer for freshening laundry in the laundry drum one of at an end of a drying process and after the laundry has dried.

16. The tumble dryer of claim 1, comprising:

a housing; and the laundry drum rotatably mounted within the housing for receiving laundry to be dried, wherein the laundry freshening device introduces a volume of liquid into the laundry in the laundry drum for freshening the laundry in the laundry drum one of at an end of a drying process and after the laundry has dried.

17. A tumble dryer comprising:

a housing;

a laundry drum rotatably mounted within the housing for receiving laundry to be dried;

a fire sensor that detects a fire in the laundry drum of the tumble dryer; and a laundry freshening device including a nozzle and a control device, the control device controlling a supply of a volume of liquid to the nozzle to create a mist, droplets, or steam from the volume of liquid, and introduce the mist, droplets, or steam into the laundry in the laundry drum for removing odors and freshening the laundry in the laundry drum one of at an end of a drying process and after the laundry has dried, and the control device controlling a supply of an extinguishing medium to the nozzle to introduce the extinguishing medium into the laundry drum of the tumble dryer upon detection of the fire by the fire sensor.

18. A tumble dryer, with a fire-extinguishing facility, the device comprising:

a fire sensor for detecting a fire in a laundry drum of the tumble dryer; and an extinguishing medium supply device for introduction of an extinguishing medium into the laundry drum of the tumble dryer on actuation of a fire-extinguishing device, wherein the extinguishing medium supply device comprises:

a laundry freshening device;

a nozzle; and a control device, wherein, in a first situation, the control device triggers the laundry freshening device to act as a fire extinguisher to control a supply of the extinguishing medium to the nozzle and to introduce the extinguishing medium into the laundry drum of the tumble dryer to extinguish the fire in response to a signal from the fire sensor, and wherein, in a second situation, the control device triggers the laundry freshening device to control a supply of a volume of liquid to the nozzle to create a volume of mist, droplets, or steam, and to introduce the volume of mist, droplets, or steam into the laundry drum for removing odors and freshening the laundry in the laundry drum.

19. A tumble dryer comprising:

a housing;

a laundry drum rotatably mounted within the housing for receiving laundry to be dried;

a fire sensor that detects a fire in the laundry drum of the tumble dryer;

a laundry freshening device;

a nozzle; and a control device, wherein, in a first situation, the control device triggers the laundry freshening device to act as a fire extinguisher to control a supply of an extinguishing medium to the nozzle and to introduce the extinguishing medium into the laundry drum of the tumble dryer to extinguish the fire in response to a signal from the fire sensor, and wherein, in a second situation including at an end of a drying process or after the laundry has dried, the control device triggers the laundry freshening device to control a supply of liquid to the nozzle to create a volume of mist, droplets, or steam, and to introduce the volume of mist, droplets, or steam into the laundry drum for removing odors and freshening the laundry in the laundry drum.

20. A method for operation of a tumble dryer, comprising:

triggering a laundry freshening device to create a mist, droplets, or steam from a volume of liquid, and introduce the mist, droplets, or steam into the laundry drum to remove odors and freshen the laundry in the laundry drum;

detecting a fire; and triggering the laundry freshening device to supply an extinguishing medium into the laundry drum of the tumble dryer to extinguish the fire, wherein the laundry freshening device includes a nozzle and a control unit, the control unit controlling the supply of the volume of liquid and the extinguishing medium to the nozzle.

21. The method of claim 20, wherein detecting a fire comprises detecting a temperature in the laundry drum and the triggering of the laundry freshening device comprises triggering the laundry freshening device if the detected temperature exceeds a fire threshold value.

22. The method of claim 20, introducing, by the laundry refreshing device, the one of the mist, droplets, and steam from the volume of liquid into the laundry in the laundry drum for freshening the laundry in the laundry drum one of at an end of a drying process and after the laundry has dried.

23. A method for operation of a tumble dryer including a laundry drum, a laundry freshening device, a fire sensor, a nozzle, and a control device, the method comprising:

triggering, by the control device in response to the detecting of a fire by the fire sensor, the laundry freshening device to supply an extinguishing medium from the nozzle and into the laundry drum of the tumble dryer for extinguishing the fire; and triggering, by the control device, the laundry freshening device to create a mist, droplets, or steam from a volume of liquid and to introduce the mist, droplets, or steam from the volume of liquid into the laundry drum from the nozzle for removing odors and freshening the laundry in the laundry drum.

* * * * *